US007861546B2

(12) United States Patent
Landers et al.

(10) Patent No.: US 7,861,546 B2
(45) Date of Patent: Jan. 4, 2011

(54) REFRIGERATION SYSTEM CAPACITY CONTROLLER AND METHOD

(75) Inventors: Daniel Landers, Woodstock, GA (US); Gregory Mickelson, Acworth, GA (US)

(73) Assignee: Computer Process Controls, Inc., Kennesaw, GA (US)

( * ) Notice: Subject to any disclaimer, the term of this patent is extended or adjusted under 35 U.S.C. 154(b) by 946 days.

(21) Appl. No.: 11/732,119

(22) Filed: Apr. 2, 2007

(65) Prior Publication Data

US 2007/0245753 A1 Oct. 25, 2007

Related U.S. Application Data

(60) Provisional application No. 60/788,860, filed on Apr. 3, 2006.

(51) Int. Cl.
*F25B 7/00* (2006.01)
*F25B 1/00* (2006.01)
*G05D 23/32* (2006.01)

(52) U.S. Cl. ..... 62/175; 62/228.3; 62/228.1; 62/157

(58) Field of Classification Search ..... 62/175, 62/228.3, 228.1, 157, 129, 217
See application file for complete search history.

(56) References Cited

U.S. PATENT DOCUMENTS 5,440,891 A * 8/1995 Hindmon et al. ..... 62/117
5,586,444 A * 12/1996 Fung ..... 62/117
6,474,085 B2 * 11/2002 Uno et al. ..... 62/175
2003/0033823 A1 2/2003 Pham et al.

FOREIGN PATENT DOCUMENTS

JP 2001-153475 6/2001
JP 09-229498 9/2007

OTHER PUBLICATIONS

International Preliminary Report on Patentability regarding International Application No. PCT/US2007/008108 dated Oct. 8, 2008.
International Search Report and the Written Opinion of the International Searching Authority, or the Declaration for PCT/US2007/008108.

* cited by examiner

*Primary Examiner*—Chen-Wen Jiang
(74) *Attorney, Agent, or Firm*—Harness, Dickey & Pierce, P.L.C.

(57) ABSTRACT

A controller and method for control of a refrigeration system having a compressor rack operable at a plurality of capacities may include determining a rate of change in suction pressure for a first capacity, determining a rate of change in suction pressure associated with a second capacity, and determining which of the first capacity and the second capacity will produce the least variation between a measured suction pressure and a desired suction pressure based on the rate of change in suction pressure associated with each.

24 Claims, 3 Drawing Sheets

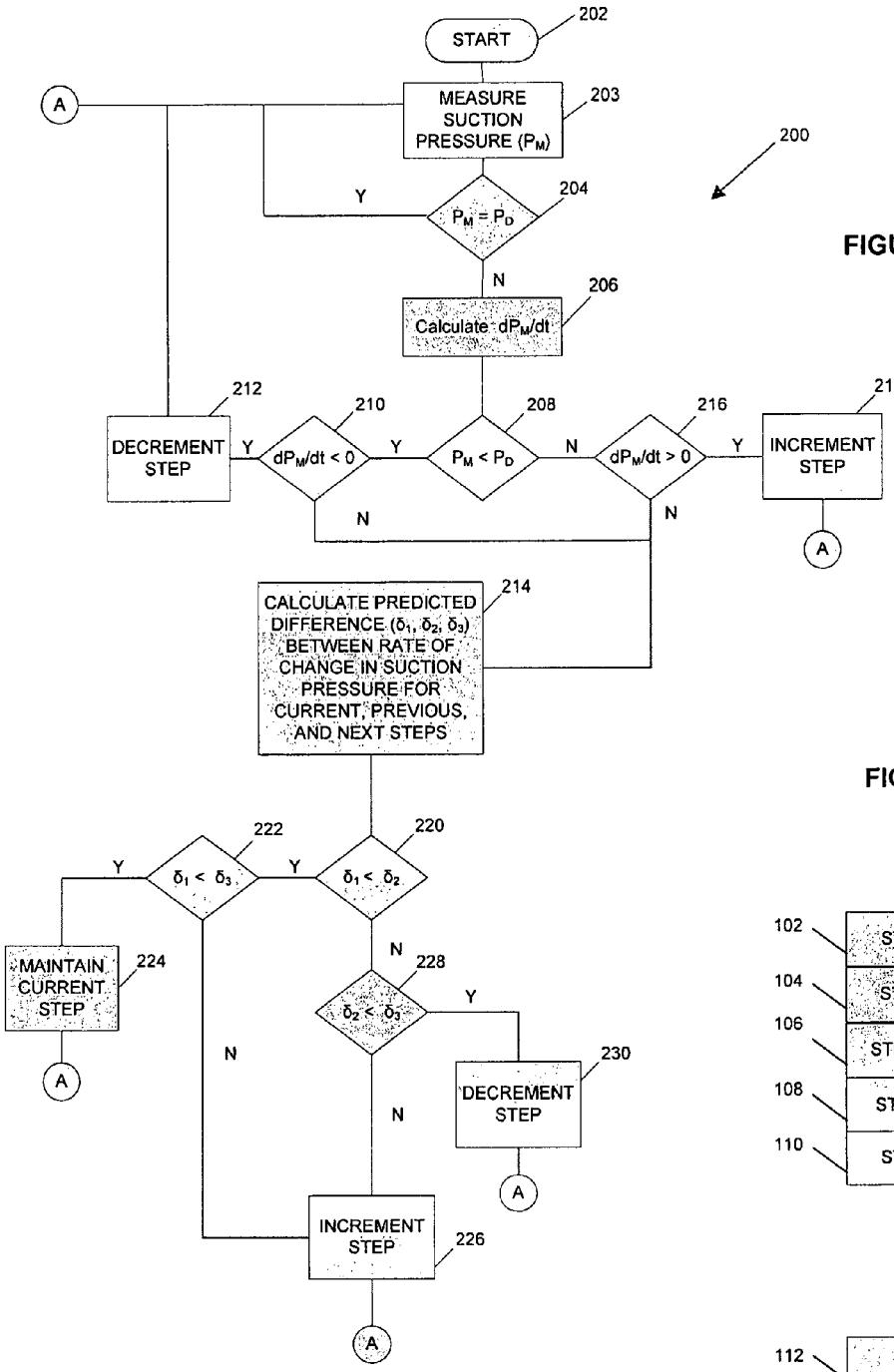
FIGURE 4
FIGURE 2
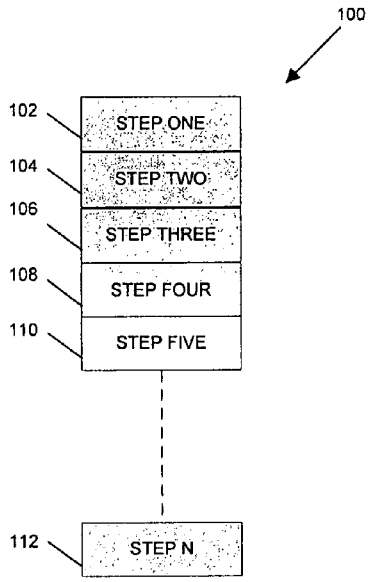

REFRIGERATION SYSTEM CAPACITY CONTROLLER AND METHOD

CROSS-REFERENCE TO RELATED APPLICATIONS

This application claims the benefit of U.S. Provisional Application No. 60/788,860, filed on Apr. 3, 2006. The disclosure of the above application is incorporated herein by reference.

FIELD

The present disclosure relates to refrigeration systems and, more particularly, to a method and apparatus for refrigeration system control.

BACKGROUND

The statements in this section merely provide background information related to the present disclosure and may not constitute prior art.

Refrigeration systems typically use a fixed-step control algorithm for control of compressor capacity based on system demand. These fixed-step systems typically advance capacity up or down based on a greater-than or less-than relationship between an operating parameter and a desired value for the operating parameter without any input regarding the predicted effect of the adjustment. As a result, compressor capacity may be increased or decreased beyond an optimal value, resulting in an overshoot or an undershoot condition, which may result in system inefficiencies.

SUMMARY

According to the present teachings, a method for control of a refrigeration system having a compressor rack operable at a plurality of capacities may include determining a rate of change in suction pressure for a first capacity, determining a rate of change in suction pressure associated with a second capacity, and determining which of the first capacity and the second capacity will produce the least variation between a measured suction pressure and a desired suction pressure based on the rate of change in suction pressure associated with each.

A method for control of a refrigeration system having a compressor rack operable at a plurality of capacities may include determining a rate of change in suction pressure for a first capacity, determining a rate of change in suction pressure associated with a second capacity, and determining which of the first capacity and the second capacity will produce the least variation between a measured suction pressure and a desired suction pressure based on the rate of change in suction pressure associated with each.

Determining the rate of change in suction pressure associated with the second capacity may include referencing a database including a rate of change in suction pressure for the second capacity. The method may include storing the rate of change in suction pressure associated with the first capacity in a database or storing at least one of a refrigeration system load and compression ratio associated with the rate of change in suction pressure of the first capacity.

The method may include determining a first difference between the rate of change in suction pressure associated with the first capacity and a desired rate of change in suction pressure. The method may further include determining a second difference between the rate of change in suction pressure associated with the second capacity and the desired rate of change in suction pressure. The method may further include comparing the first and second differences.

The plurality of capacities may include a fixed number of capacities, and may further include determining the rate of change in suction pressure associated with a third capacity, the second capacity being less than the first capacity and the third capacity being greater than the first capacity. Determining the rate of change in suction pressure associated with the second and third capacities may include determining a rate of change in suction pressure associated with one of a capacity immediately prior to and immediately after the first capacity. The first capacity may be a current operating capacity of the compressor.

A method for control of a refrigeration system having a compressor rack operable at a plurality of capacities may include determining a rate of change in suction pressure associated with a first capacity, determining a rate of change in suction pressure associated with a second capacity, determining a desired rate of change in suction pressure, determining a first difference between the desired rate of change and the rate of change associated with the first capacity, determining a second difference between the desired rate of change and the rate of change associated with the second capacity, comparing the first and second differences; and selecting a capacity based on the comparing.

Determining whether a suction pressure associated with an operating capacity of the compressor may be one of greater than, less than, or equal to a desired suction pressure. The method may further include determining whether the suction pressure associated with the operating capacity of the compressor is one of increasing and decreasing. The method may further include determining whether a suction pressure associated with an operating capacity of the compressor is greater than, less than, or equal to the desired suction pressure is performed, then determining whether the suction pressure associated with the operating capacity of the compressor is one of increasing and decreasing is performed, and then determining the first and second differences.

The first capacity may be associated with a current operating capacity of the compressor. Determining the rate of change in suction pressure associated with the first capacity may include calculating the rate of change. The method may further include storing the rate of change in suction pressure associated with the first capacity in a database. Determining the rate of change in suction pressure associated with a second capacity may include referencing a database including a rate of change in suction pressure for the second capacity.

A method for control of a refrigeration system having a compressor rack operable at a plurality of capacities includes operating a compressor rack at a first capacity, determining the rate of change in suction pressure associated with the first capacity, and referencing a database to determine the rate of change in suction pressure associated with a second capacity.

The method may further include storing the rate of change in suction pressure associated with the first capacity in the database. The method may further include referencing the database to determine the rate of change in suction pressure associated with a third capacity. The second capacity may be less than the first capacity and the third capacity may be greater than the first capacity. The method may further include determining a desired rate of change in suction pressure and comparing the desired rate of change to the rates of change in suction pressure associated with the first and second capacities.

A controller may include a first suction pressure rate of change determination module to determine a first rate of change in suction pressure associated with a first capacity of a compressor rack in a refrigeration system, a second suction pressure rate of change determination module may determine a second rate of change in suction pressure associated with a second capacity of the compressor rack, and a suction pressure rate of change evaluation module in communication with the first suction pressure rate of change determination module and the second suction pressure rate of change determination module may determine which of the first and second capacities will produce the least variation between a measured suction pressure and a desired suction pressure based on the first and second rates of change in suction pressure.

The second suction pressure rate of change determination module may include a compressor rack database storage module that includes a database including the second rate of change in suction pressure. The controller may further include a compressor rack database storage module in communication with the first suction pressure rate of change determination module and including a database to store the first rate of change in suction pressure. The compressor rack database storage module may store at least one of a refrigeration system load and a compression ratio associated with the first rate of change in suction pressure.

The controller may further include a third suction pressure rate of change determination module to determine a desired rate of change in suction pressure and communicate with the suction pressure rate of change evaluation module. The suction pressure rate of change evaluation module may determine a first difference between the first rate of change and the desired rate of change. The suction pressure rate of change evaluation module may determine a second difference between the second rate of change and the desired rate of change. The suction pressure rate of change evaluation module may also compare the first and second differences.

The compressor rack is operable at a fixed number of capacities and the second suction pressure rate of change determination module may determine a third rate of change in suction pressure associated with a third capacity of the compressor rack which is greater than the first capacity and wherein the first capacity is greater than the second capacity. The second capacity may be one of immediately prior to and immediately after the first capacity. The third capacity may be the other of immediately prior to and immediately after the first capacity.

A controller includes a first suction pressure rate of change determination module to determine a first rate of change in suction pressure associated with a first capacity of a compressor rack in a refrigeration system; a second suction pressure rate of change determination module determines a second rate of change in suction pressure associated with a second capacity of the compressor rack; a third suction pressure rate of change determination module determines a desired rate of change in suction pressure; a suction pressure rate of change evaluation module in communication with the first, second, and third suction pressure rate of change determination modules to determine a first difference between the desired rate of change and the first rate of change, a second difference between the desired rate of change and the second rate of change, and to evaluate the first and second differences relative to one another; and a compressor rack capacity selection module in communication with the suction pressure rate of change evaluation module selects a capacity based on the evaluation of the first and second differences.

The controller may further include an operating suction pressure determination module to determine a current operating suction pressure, a desired suction pressure determination module to determine a desired suction pressure, and an operating suction pressure evaluation module in communication with the operating suction pressure determination module and the desired suction pressure determination module to determine whether the operating suction pressure is one of greater than, less than, or equal to the desired suction pressure. The suction pressure rate of change evaluation module may determine whether the operating suction pressure is one of increasing and decreasing.

The first capacity may be associated with a current operating capacity of the compressor. In this case, the first suction pressure rate of change determination module calculates the first rate of change. The controller may further include a compressor rack database storage module in communication with the suction pressure rate of change evaluation module to store the first rate of change therein. The second suction pressure rate of change determination module may include a compressor rack database storage module that includes said second rate of change.

A controller includes a first suction pressure rate of change determination module to determine a first rate of change in suction pressure associated with a current operating capacity of a compressor rack in a refrigeration system, a compressor rack database storage module including a second rate of change in suction pressure associated with a second capacity of the compressor rack, a suction pressure rate of change evaluation module in communication with the first suction pressure rate of change determination module and the compressor rack database storage module to evaluate the first and second rates of change relative to one another, and a compressor rack capacity selection module in communication with the suction pressure rate of change evaluation module to select a capacity based on the evaluation of the first and second rates of change.

The compressor rack database storage module may be in communication with the first suction pressure rate of change determination module to store the first rate of change therein. The compressor rack database storage module may include a third rate of change in suction pressure associated with a third capacity of the compressor rack. In this case, the second capacity may be less than the first capacity and the third capacity may be greater than the first capacity.

The controller may further include a desired suction pressure rate of change determination module to determine a desired rate of change in suction pressure and in communication with the suction pressure rate of change evaluation module to evaluate the first and second rates of change relative to the desired rate of change.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 2 is an illustration of the various capacities associated with the compressor rack of FIG. 1;

FIG. 4 is a flow chart illustrating compressor rack capacity control.

DETAILED DESCRIPTION

The following description is merely exemplary in nature and is not intended to limit the present disclosure, application, or uses.

Figure 1:
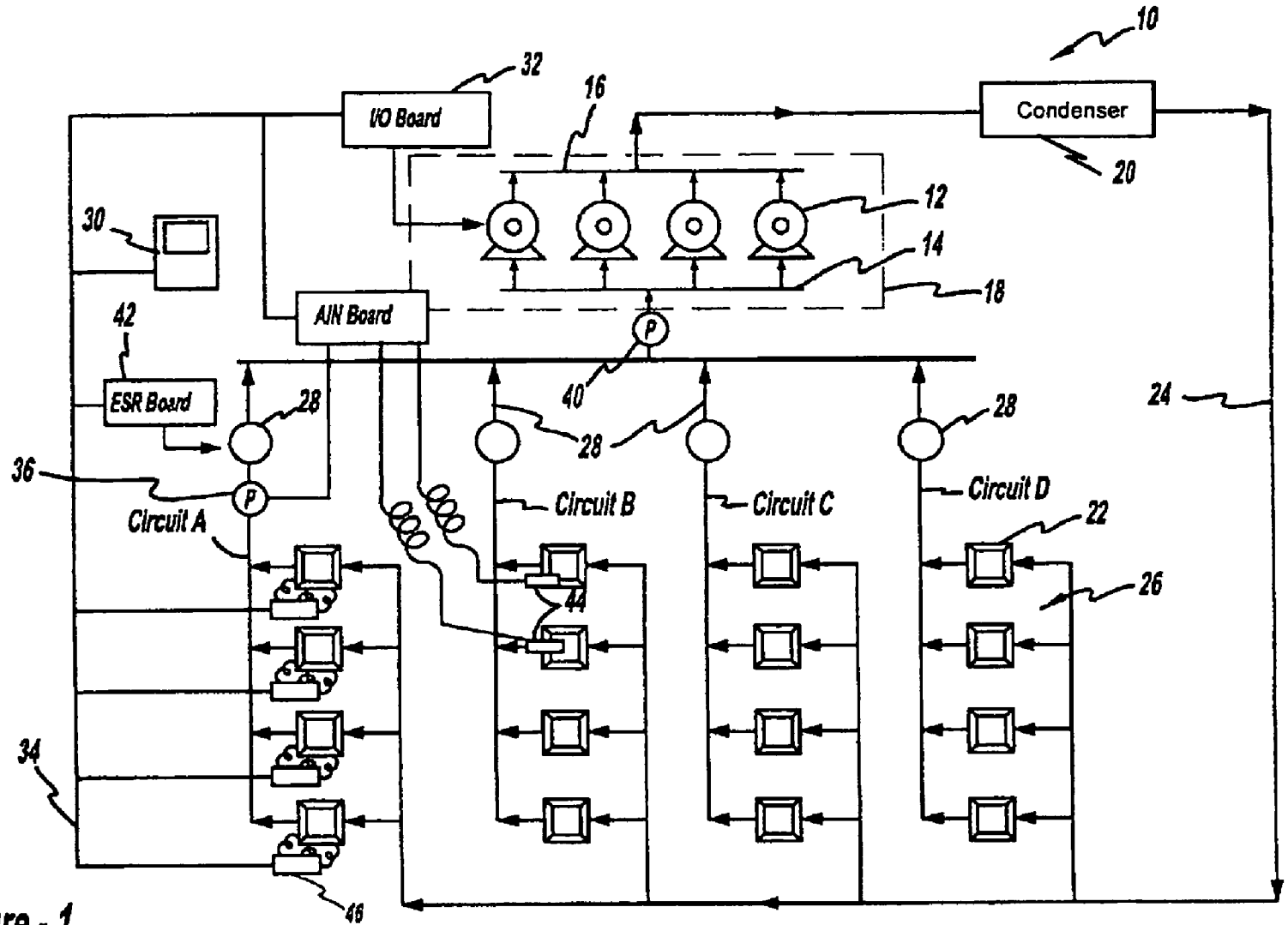
FIG. 1 is a block diagram of a refrigeration system employing a method and apparatus for refrigeration system control according to the present disclosure.

Referring to FIG. 1, a block diagram of a refrigeration system 10 is shown according to the present teachings. Refrigeration system 10 may include a plurality of compressors 12 piped together with a suction manifold 14 and a discharge header 16. Compressors 12, suction manifold 14, and discharge header 16 may all be positioned within a compressor rack 18.

Refrigeration system 10 may further include a condenser 20 and a plurality of refrigeration cases 22. Compressors 12 may be in communication with condenser 20 through discharge header 16. A piping 24 may extend between and provide communication between condenser 20 and refrigeration cases 22. Refrigeration cases 22 may be arranged in separate circuits 26. Each of circuits 26 may include a plurality of refrigeration cases 22 operating within similar temperature ranges. In the present example, shown in FIG. 1, four (4) circuits 26 are shown (labeled A, B, C, D). Each circuit 26 is shown including four (4) refrigeration cases 22. However, it is understood that any number of refrigeration cases 22 or circuits 26 may be used.

A plurality of pressure regulators 28 may be included with and located at an outlet of each circuit 26. Pressure regulators 28 may provide communication between circuits 26 and compressor suction manifold 14. Pressure regulator 28 may include an electronic stepper regulator (ESR) or a valve which acts to control the evaporator pressure, and therefore the temperature of the refrigerated space in refrigeration cases 22. Each refrigeration case 22 may also include an evaporator and expansion valve which may be a mechanical or electronic valve for controlling the superheat of the refrigerant.

Compressor rack 18 may generally compress refrigerant vapor which may then travel to condenser 20 where the refrigerant vapor is liquefied at high pressure. This high pressure liquid may then be delivered to refrigeration cases 22 through piping 24. The refrigerant may pass through the expansion valves in each of refrigeration cases 22 where a pressure drop occurs to change the high pressure liquid refrigerant to a lower pressure combination of a liquid and a vapor. As the hot air from the refrigeration case 22 moves across the evaporator coil, the low pressure liquid turns into gas. This low pressure gas is delivered to the pressure regulator 28 associated with that particular circuit 26. The pressure is reduced at pressure regulator 28 as the gas returns to compressor rack 18. The low pressure gas is again compressed to a high pressure and delivered to condenser 20, where high pressure liquid is created to start the refrigeration cycle over again.

A main refrigeration controller 30 may be used to control various functions of refrigeration system 10. Main refrigeration controller 30 may be configured or programmed to control operation of each pressure regulator 28, as well as the suction pressure set point for the entire compressor rack 18, further discussed herein. Refrigeration controller 30 may be an Einstein or E2 Area Controller offered by CPC, Inc. of Atlanta, Ga., or any other type of controller which may be programmed.

Refrigeration controller 30 may control compressors 12 via an input/output module 32. Input/output module 32 may include relay switches to turn compressors 12 on and off to provide the desired suction pressure. A separate controller, such as CC-100 case controller, also offered by CPC, Inc. of Atlanta, Ga. may be used to control the superheat of the refrigerant to each refrigeration case 22 via the electronic expansion valve in each of refrigeration cases 22 by way of a communication network or bus 34. Alternatively, a mechanical expansion valve may be used in place of the separate case controller. Should separate case controllers be utilized, main refrigeration controller 30 may be used to configure each separate case controller, also via communication bus 34. Communication bus 34 may either be a RS-485 communication bus or a LonWorks Echelon bus which enables main refrigeration controller 30 and the separate case controllers to receive information from each refrigeration case 22.

A pressure transducer 36 may be provided in each circuit for monitoring circuit pressure. Pressure transducer 36 may be located at the outlet of the refrigeration cases 22 of circuit 26. Alternatively, pressure transducer 36 may be located just prior to pressure regulator 28. Pressure transducers 36 may each deliver an analog signal to an analog input board 38 which measures the analog signal and delivers this information to the main refrigeration controller 30, via communication bus 34. Analog input board 38 may be a conventional analog input board utilized in the refrigeration control environment.

An additional pressure transducer 40 may be utilized to measure suction pressure for compressor rack 18. The signal from pressure transducer 40 may also be an analog signal and may be delivered to analog input board 38. Pressure transducer 40 enables adaptive control of suction pressure for compressor rack 18, as discussed below. An electronic stepper regulator (ESR) board 42 may be used to vary openings in each pressure regulator 28. Pressure regulator 28 may include an electronic stepper regulator valve. ESR board 42 may be capable of driving up to eight (8) pressure regulators 28. ESR board 42 may be an ESR 8 board offered by CPC, Inc. of Atlanta, Ga., which consists of eight (8) drivers capable of driving pressure regulators 28 via control from main refrigeration controller 30.

Ambient temperature inside refrigeration cases 22 may be used in place of pressure readings from pressure transducer 36 to control opening of each pressure regulator 28. As seen in FIG. 1, circuit B is shown having temperature sensors 44 associated with each individual refrigeration case 22. Each refrigeration case 22 in circuit B may have a separate temperature sensor to take average/min/max temperatures used to control pressure regulator 28. Alternatively, a single temperature sensor 44 may be used in one refrigeration case 22 within circuit B, since each of refrigeration cases 22 in a circuit 26 operate at substantially the same temperature range. These temperature inputs may also be provided to analog input board 38, which returns the information to main refrigeration controller 30 via communication bus 34.

Control of refrigeration system 10 may include the use of a database. The database may include an array of historical data. The historical data may be compiled prior to operation of refrigeration system 10 or may be compiled, amended and/or appended during operation. The historical data may include data corresponding to a variety of refrigeration system 10 operating conditions, such as compressor load and compression ratio. The historical data may include data corresponding to a variety of compressor rack capacities. More specifically, in the present example, the historical data includes compressor rack suction pressure rate of change for various compressor rack capacities.

Compressor rack 18 may be operable at a variety of capacities associated with a number of fixed operating steps 100 arranged in series, depicted in FIG. 2. Each of operating steps 100 may be associated with a different compressor rack capacity. For purposes of illustration, the capacities associated with the varying operating steps 100 may be arranged in increasing order. For example, as shown in FIG. 2, five steps 102, 104, 106, 108, 110 are shown, but more or fewer steps could be used, as illustrated by step N 112. Step one 102 may be associated with the lowest compressor rack capacity and step five 110 may be associated with the highest compressor rack capacity, with steps two through four 104, 106, 108 increasing compressor rack capacity between step one 102 and step five 110. The differing compressor rack capacities may be achieved in a variety of ways, including varying the number of compressors 12 being operated or modulating the capacity of compressors 12. Modulating capacity of compressors 12 may include varying operating speed of compressors 12 or causing a leak path to reduce efficiency in compressors 12. The step at which compressor rack 18 is operated may be determined based on the historical data previously mentioned in order to achieve a desired operating parameter, such as the suction pressure measured at pressure transducer 40 in FIG. 1.

The historical data may include the rate of change in suction pressures. Suction pressure may be measured at time intervals at pressure transducer 40. Differentiation of these pressure readings with respect to time may provide the rate of change in suction pressure. During operation of refrigeration system 10, measured suction pressure ($P_M$) may be compared to a desired suction pressure ($P_D$). Desired suction pressure may include a range of acceptable pressures. Specifically, desired pressure may generally include a setpoint pressure +/− a deadband. The deadband may generally represent an acceptable level of variation in the measured suction pressure.

Figure 3:
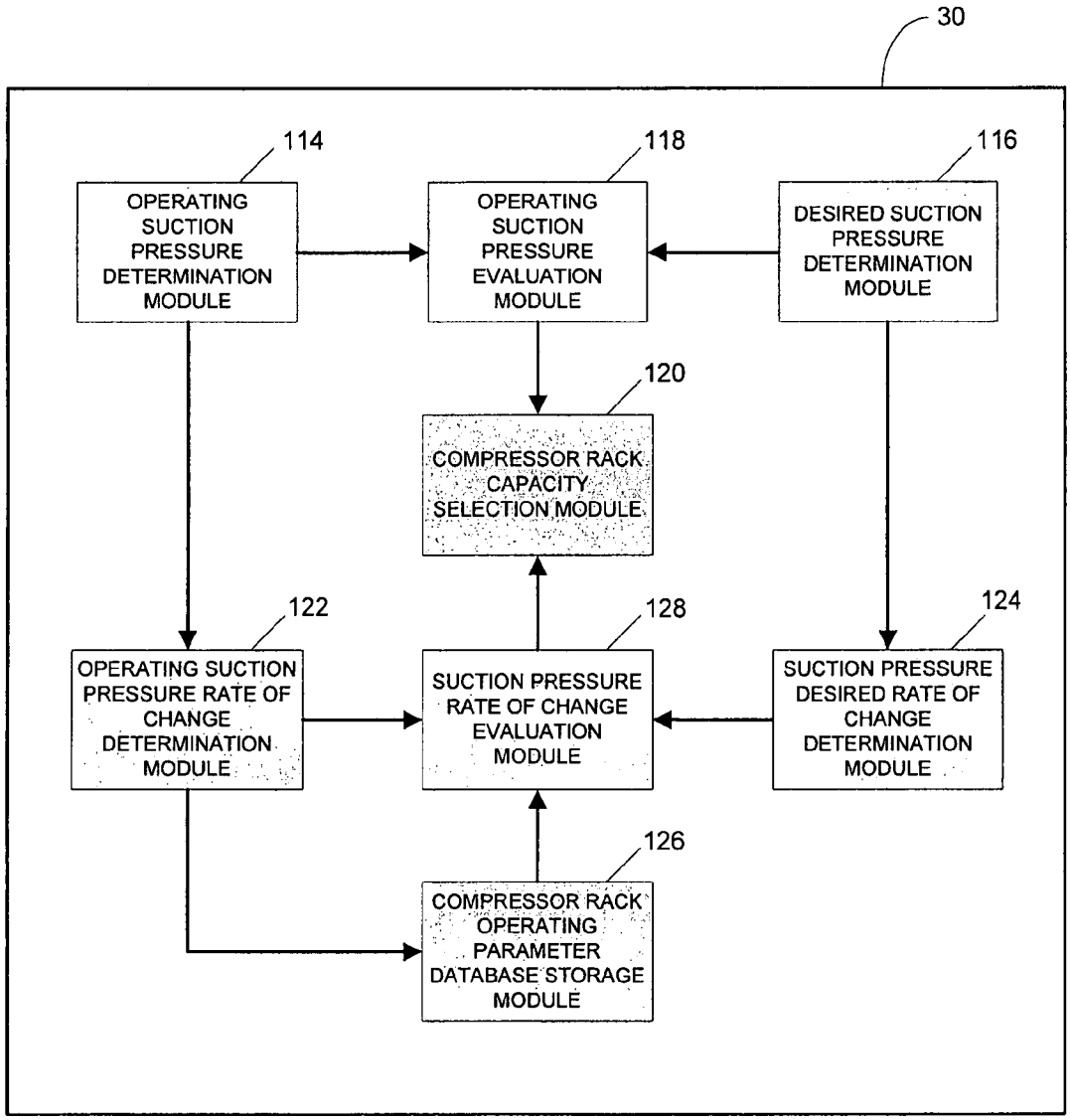
FIG. 3 is a functional block diagram of the refrigeration controller shown in FIG. 1.

With additional reference to FIG. 3, refrigeration controller 30 may include an operating suction pressure determination module 114, a desired suction pressure determination module 116, an operating suction pressure evaluation module 118, a compressor rack capacity selection module 120, an operating suction pressure rate of change determination module 122, a suction pressure desired rate of change determination module 124, a compressor rack operating parameter database storage module 126, and a suction pressure rate of change evaluation module 128. Operating suction pressure determination module 114 may be in communication with operating suction pressure evaluation module 118 and operating suction pressure rate of change determination module 122 and may provide signals thereto indicative of operating suction pressure provided by pressure transducer 40. Desired suction pressure determination module 116 may be in communication with operating suction pressure evaluation module 118 and suction pressure desired rate of change determination module 124 and may provide a signal thereto indicative of a desired suction pressure.

Operating suction pressure evaluation module 118 may be in communication with compressor rack capacity selection module 120 and may provide a signal thereto indicative of the relationship between the operating suction pressure provided by operating suction pressure determination module 114 and the desired suction pressure provided by desired suction pressure determination module 116. Operating suction pressure rate of change determination module 122 may form a first suction pressure rate of change determination module and may be in communication with compressor rack operating parameter database storage module 126 and suction pressure rate of change evaluation module 128 and may provide a signal thereto indicative of a rate of change in suction pressure corresponding to a current compressor operating capacity based on the operating suction pressure provided by operating suction pressure determination module 114.

Compressor rack operating parameter database storage module 126 may form a second suction pressure rate of change determination module and may be in communication with suction pressure rate of change evaluation module 128 and may provide a signal thereto indicative of a suction pressure rate of change associated with an alternate compressor operating capacity. Suction pressure desired rate of change determination module 124 may form a third suction pressure rate of change determination module and may be in communication with suction pressure rate of change evaluation module 128 and may provide a signal thereto indicative of a desired rate of change in suction pressure based on the desired suction pressure provided by desired suction pressure determination module 116.

Suction pressure rate of change evaluation module 128 may be in communication with compressor rack capacity selection module 120 and may provide a signal thereto indicative of a relationship between operating and desired rates of change in suction pressure. Compressor rack capacity selection module 120 may determine an operating step for compressor rack 18, as discussed below.

As seen in FIG. 4, an exemplary suction pressure control logic 200 associated with refrigeration controller 30 for determining the operating step of compressor rack 18 is shown. Suction pressure control logic 200 is based on taking suction pressure measurements from pressure transducer 40, shown in FIG. 1. Suction pressure control logic begins at start block 202, from which control logic 200 proceeds to control block 203, where suction pressure is measured. Operating suction pressure determination module 114 may determine the suction pressure by the suction pressure measurement at control block 203. From control block 203, control logic 200 proceeds to determination block 204, where operating suction pressure evaluation module 118 determines whether the measured suction pressure is equal to the desired suction pressure (or setpoint pressure +/− deadband). If the measured suction pressure is equal to the desired suction pressure, control logic 200 proceeds to control block 203 to measure suction pressure again and compare the measured suction pressure to the desired suction pressure at determination block 204.

If the measured suction pressure is not equal to the desired suction pressure, control logic 200 proceeds to control block 206 where the rate of change in suction pressure for the current step is determined by operating suction pressure rate of change determination module 122. Next, control logic 200 proceeds to determination block 208. Determination block 208 compares measured suction pressure to desired suction pressure using operating suction pressure evaluation module 118. If measured suction pressure is less than desired suction pressure, control logic 200 proceeds to determination block 210.

Determination block 210 evaluates whether measured suction pressure is increasing or decreasing using suction pressure rate of change evaluation module 128. If measured suction pressure is decreasing, control logic 200 proceeds to control block 212, where compressor rack capacity selection module 120 decrements the operating step of compressor rack 18 to the previous step. For example, if compressor rack 18 is operating at step three 106, the step is reduced to step two 104. If the current operating step is the lowest step, step one 102, then the current operating step is maintained. Control logic 200 proceeds to control block 203 from control block 212, where control resumes as described above. If measured suction pressure is increasing, control logic 200 proceeds to control block 214, discussed below.

Referring back to determination block 208, if measured suction pressure is greater than desired suction pressure, control logic 200 proceeds to determination block 216, where suction pressure rate of change evaluation module 128 evaluates whether suction pressure is increasing or decreasing during the previous iteration of control logic 200. If the measured suction pressure is increasing, control logic 200 proceeds to control block 218, where compressor rack capacity selection module 120 increments the operating step of compressor rack 18 to the next step. For example, if compressor rack 18 is operating at step three 106, the step is increased to step four 108. If the current operating step is the highest step, step five 110, the current operating step is maintained. Control logic 200 proceeds to control block 203 from control block 218, where control resumes as described above. If measured suction pressure is decreasing, control logic 200 proceeds to control block 214.

Control block 214 uses suction pressure rate of change evaluation module 128 to calculate the desired rate of change in suction pressure ($dP_D/dt$) and suction pressure rate of change evaluation module 128 to determine the difference between the desired rate and the measured rate of change in suction pressure ($dP_M/dt-dP_D/dt$) for the current compressor rack operating step and the historical data for suction pressure rate of change ($dP_{PS}/dt-dP_D/dt$, $dP_{NS}/dt-dP_D/dt$) for the previous and next steps. The historical data may be provided by compressor rack operating parameter database storage module 126. In the example described above, the desired rate of change in suction pressure may be determined by dividing the difference between measured suction pressure and desired suction pressure by a user-defined time interval ($dP_D/dt=[P_M-P_D]/\Delta t$). The desired suction pressure may be provided by desired suction pressure determination module 116 and the desired rate of change in suction pressure ($dP_D/dt$) may be determined using suction pressure desired rate of change determination module 124. The historical data may be referenced to determine the rate of change in suction pressure associated with the previous compressor rack operating step ($dP_{PS}/dt$) and the next compressor rack operating step ($dP_{NS}/dt$). The differences ($\delta_1=abs[dP_M/dt-dP_D/dt]$, $\delta_2=abs[dP_{PS}/dt-dP_D/dt]$, $\delta_3=abs[dP_{NS}/dt-dP_D/dt]$) between the measured rate of change in suction pressure ($dP_M/dt$) and the rates of change in suction pressure ($dP_{PS}/dt$, $dP_{NS}/dt$) associated with the previous and next steps and the desired rate of change in suction pressure ($dP_D/dt$) are determined using suction pressure rate of change evaluation module 128. Control logic 200 then proceeds to determination block 220.

Determination block 220 evaluates whether difference $\delta_1$ is less than difference $\delta_2$ using suction pressure rate of change evaluation module 128. If $\delta_1$ is less than $\delta_2$, control logic 200 proceeds to determination block 222, where suction pressure rate of change evaluation module 128 evaluates difference $\delta_1$ relative to difference $\delta_3$.

If determination block 222 determines that $\delta_1$ is less than $\delta_3$, the current step is predicted to produce the smallest difference between the desired rate of change in suction pressure and measured rate of change in suction pressure in the next operating cycle of compressor rack 18 over time step ($\Delta t$), making the current step the most efficient operating step. Therefore, control logic 200 proceeds to control block 224, where compressor rack capacity selection module 120 maintains the current step. Control logic 200 then proceeds to control block 203, where control logic operation continues as described above.

If determination block 222 determines that $\delta_1$ is greater than $\delta_3$, the next step is predicted to produce the smallest difference between the desired rate of change in suction pressure and the measured rate of change in suction pressure in the next operating cycle of compressor rack 18 over time step ($\Delta t$), making the next step the most efficient operating step. Therefore, control logic 200 proceeds to control block 226, where compressor rack capacity selection module 120 selects the next step. Control logic 200 then proceeds to control block 203, where control logic operation continues as described above.

Referring back to determination block 220, if $\delta_1$ is greater than $\delta_2$, control logic 200 proceeds to determination block 228, which evaluates difference $\delta_2$ relative to difference $\delta_3$ using suction pressure rate of change evaluation module 128.

If determination block 228 determines that $\delta_2$ less than $\delta_3$, the previous step is predicted to produce the smallest difference between the desired rate of change in suction pressure and the measured rate of change in suction pressure in the next operating cycle of compressor rack 18 over time step ($\Delta t$), making the previous step the most efficient operating step. Therefore, control logic 200 proceeds to control block 230, where compressor rack capacity selection module 120 selects the previous step. Control logic 200 then proceeds to control block 203, where control logic operation continues as described above.

If determination block 228 determines that $\delta_2$ is greater than $\delta_3$, the next step is predicted to produce the smallest difference between the desired rate of change in suction pressure and the measured rate of change in suction pressure in the next operating cycle of compressor rack 18 over time step ($\Delta t$), making the next step the most efficient operating step. Therefore, control logic 200 proceeds to control block 226, where compressor rack capacity selection module 120 selects the next step. Control logic 200 then proceeds to control block 203, where control logic operation continues as described above.

While the determination blocks have been described as performing evaluations in a specific order for specified parameters, it is understood that this order and parameter evaluation may be modified while providing the same result. Specifically, differences $\delta_1$, $\delta_2$, $\delta_3$ may have the comparisons rearranged with the same end result.

As indicated above, the present example is merely intended to illustrate the present teachings. While the present example discusses evaluating the current, previous, and next steps, it is understood that any number of steps may be evaluated when determining whether to change the current operating step. Accordingly, it is also understood that control logic may provide that the current step may advance or move back to any available step. Evaluation of multiple steps and advancing or moving back beyond the immediate next or previous step may be beneficial during a pump-down condition. During a pump-down condition, refrigeration load may decrease rapidly. Therefore, it may be beneficial to quickly adjust suction pressure of compressors 12.

What is claimed is:

1. A method for control of a refrigeration system having a compressor rack operable at a plurality of capacities, said method comprising:

determining a rate of change in suction pressure for a first capacity;

determining a rate of change in suction pressure associated with a second capacity; and determining which of the first capacity and the second capacity will produce the least variation between a measured suction pressure and a desired suction pressure based on the rate of change in suction pressure associated with each.

2. The method of claim 1, wherein said determining the rate of change in suction pressure associated with the second capacity includes referencing a database including a rate of change in suction pressure for the second capacity.

3. The method of claim 1, further comprising storing the rate of change in suction pressure associated with the first capacity in a database.

4. The method of claim 3, further comprising storing at least one of a refrigeration system load and compression ratio associated with the rate of change in suction pressure of the first capacity.

5. The method of claim 1, wherein the plurality of capacities includes a fixed number of capacities, said method further comprising determining the rate of change in suction pressure associated with a third capacity, the second capacity being less than the first capacity and the third capacity being greater than the first capacity.

6. The method of claim 5, wherein said determining the rate of change in suction pressure associated with the second and third capacities includes determining a rate of change in suction pressure associated with one of a capacity immediately prior to and immediately after the first capacity.

7. The method of claim 5, wherein the first capacity is a current operating capacity of the compressor.

8. A method for control of a refrigeration system having a compressor rack operable at a plurality of capacities, said method comprising:

determining a rate of change in suction pressure associated with a first capacity;

determining a rate of change in suction pressure associated with a second capacity;

determining a desired rate of change in suction pressure;

determining a first difference between the desired rate of change and the rate of change associated with the first capacity;

determining a second difference between the desired rate of change and the rate of change associated with the second capacity;

comparing the first and second differences; and selecting a capacity based on said comparing.

9. The method of claim 8, further comprising determining whether a suction pressure associated with an operating capacity of the compressor is one of greater than, less than, or equal to a desired suction pressure.

10. The method of claim 9, further comprising determining whether the suction pressure associated with the operating capacity of the compressor is one of increasing and decreasing.

11. The method of claim 10, wherein said determining whether a suction pressure associated with an operating capacity of the compressor is greater than, less than, or equal to the desired suction pressure is performed, then said determining whether the suction pressure associated with the operating capacity of the compressor is one of increasing and decreasing is performed, and then said determining the first and second differences is performed.

12. The method of claim 8, wherein the first capacity is associated with a current operating capacity of the compressor.

13. The method of claim 12, wherein said determining the rate of change in suction pressure associated with the first capacity includes calculating the rate of change.

14. A controller comprising:

a first suction pressure rate of change determination module to determine a first rate of change in suction pressure associated with a first capacity of a compressor rack in a refrigeration system;

a second suction pressure rate of change determination module to determine a second rate of change in suction pressure associated with a second capacity of the compressor rack; and a suction pressure rate of change evaluation module in communication with said first suction pressure rate of change determination module and said second suction pressure rate of change determination module to determine which of said first and second capacities will produce the least variation between a measured suction pressure and a desired suction pressure based on said first and second rates of change in suction pressure.

15. The controller of claim 14, wherein said second suction pressure rate of change determination module includes a compressor rack database storage module that includes a database including said second rate of change in suction pressure.

16. The controller of claim 14, further comprising a compressor rack database storage module in communication with said first suction pressure rate of change determination module and including a database to store said first rate of change in suction pressure.

17. The controller of claim 16, wherein said compressor rack database storage module stores at least one of a refrigeration system load and a compression ratio associated with the first rate of change in suction pressure.

18. The controller of claim 14, wherein the compressor rack is operable at a fixed number of capacities and said second suction pressure rate of change determination module determines a third rate of change in suction pressure associated with a third capacity of the compressor rack which is greater than said first capacity and wherein said first capacity is greater than said second capacity.

19. The controller of claim 18, wherein said second capacity is one of immediately prior to and immediately after said first capacity and said third capacity is the other of immediately prior to and immediately after said first capacity.

20. A controller comprising:

a first suction pressure rate of change determination module to determine a first rate of change in suction pressure associated with a first capacity of a compressor rack in a refrigeration system;

a second suction pressure rate of change determination module to determine a second rate of change in suction pressure associated with a second capacity of the compressor rack;

a third suction pressure rate of change determination module to determine a desired rate of change in suction pressure;

a suction pressure rate of change evaluation module in communication with said first, second, and third suction pressure rate of change determination modules to determine a first difference between said desired rate of change and said first rate of change, a second difference between said desired rate of change and said second rate of change, and to evaluate said first and second differences relative to one another; and a compressor rack capacity selection module in communication with said suction pressure rate of change evaluation module to select a capacity based on the evaluation of said first and second differences.

21. The controller of claim 20, further comprising an operating suction pressure determination module to determine a current operating suction pressure, a desired suction pressure determination module to determine a desired suction pressure, and an operating suction pressure evaluation module in communication with said operating suction pressure determination module and said desired suction pressure determination module to determine whether said operating suction pressure is one of greater than, less than, or equal to said desired suction pressure.

22. The controller of claim 21, wherein said suction pressure rate of change evaluation module determines whether said operating suction pressure is one of increasing and decreasing.

23. The controller of claim 20, wherein said first capacity is associated with a current operating capacity of the compressor.

24. The controller of claim 23, wherein said first suction pressure rate of change determination module calculates said first rate of change.

* * * * *